US007818817B1

(12) United States Patent
Owens et al.

(10) Patent No.: US 7,818,817 B1
(45) Date of Patent: Oct. 26, 2010

(54) GARMENT DEODORANT STAIN PROTECTOR

(76) Inventors: Larry Owens, 1013 W. Hearne Way, Gilbert, AZ (US) 85233; Aaron Neuhauser, 406 Alameda de las Pulgas, Belmont, CA (US) 94002

( * ) Notice: Subject to any disclaimer, the term of this patent is extended or adjusted under 35 U.S.C. 154(b) by 0 days.

(21) Appl. No.: 11/857,187

(22) Filed: Sep. 18, 2007

Related U.S. Application Data

(60) Provisional application No. 60/825,989, filed on Sep. 18, 2006.

(51) Int. Cl.
*A41D 27/12* (2006.01)

(52) U.S. Cl. ..... 2/54; 2/46

(58) Field of Classification Search ..... 2/53–59, 2/105, 106, 109–115, 69, 46, 913, 914
See application file for complete search history.

(56) References Cited

U.S. PATENT DOCUMENTS

| | | | | |
|---|---|---|---|---|
| 223,621 | A | | 1/1880 | Williams |
| 567,285 | A | | 9/1896 | Wormer |
| 817,961 | A | | 4/1906 | Davis |
| 1,080,451 | A | * | 12/1913 | Hutchinson ..... 2/114 |
| 1,137,452 | A | | 4/1915 | Bienstock |
| 1,233,156 | A | * | 7/1917 | Zies ..... 2/114 |
| 1,250,836 | A | | 12/1917 | Fowler |
| 1,363,727 | A | | 12/1920 | Guinzburg |
| 2,045,157 | A | | 6/1936 | Mathias |
| 2,686,913 | A | | 8/1954 | Brierley |
| 3,116,491 | A | * | 1/1964 | Previdi et al. ..... 2/106 |
| 3,421,514 | A | * | 1/1969 | Friedlander ..... 450/30 |
| 3,877,078 | A | | 4/1975 | Tepper |
| D309,666 | S | | 8/1990 | Gold |
| 5,042,089 | A | | 8/1991 | Carmer |
| 5,088,117 | A | * | 2/1992 | Fulmer ..... 2/114 |
| 5,245,707 | A | | 9/1993 | Green |
| 6,226,798 | B1 | * | 5/2001 | Le Blanc et al. ..... 2/69 |

* cited by examiner

*Primary Examiner*—Gloria Hale
(74) *Attorney, Agent, or Firm*—Booth Udall, PLC

(57) ABSTRACT

A garment deodorant stain protector and method are described. A garment deodorant stain protector may comprise two, distinct pieces—a right side member and a left side member. Each right side member and left side member may comprise a sleeve portion, a torso portion, and a neck portion. A method of protecting a garment from deodorant marks and stains while a person is dressing may comprise: putting on a garment deodorant stain protector; putting on the garment over the installed garment deodorant stain protector; and removing the garment deodorant stain protector.

17 Claims, 13 Drawing Sheets

GARMENT DEODORANT STAIN PROTECTOR

CROSS REFERENCE TO RELATED APPLICATIONS

This application claims priority to U.S. Provisional Patent Application entitled "Garment Deodorant Stain/Mark Protector," Ser. No. 60/825,989, filed Sep. 18, 2006, the disclosure of which is incorporated entirely herein by reference.

BACKGROUND

A. Technical Field

This document relates to a garment deodorant stain protector and a method of using the same.

B. Background

Some conventional devices exist that try and solve the problem of under-arm perspiration and its unsightliness and damage to clothing. However, overlooked by these conventional products is the need to protect clothing (for example, tight, pullover, and dark colored clothing) from deodorant stains/marks while a person is dressing himself/herself.

SUMMARY

In an aspect, this document features a garment deodorant stain protector. The garment deodorant stain protector may comprise a right side member and a left side member, each right side member and left side member comprising a sleeve portion, a torso portion, and a neck portion.

Implementations may comprise one or more of the following.

Each sleeve portion may be either coupled to or integrally joined with each torso portion, and each neck portion may be integrally joined to each torso portion. Accordingly, each sleeve portion may be coupled to each torso portion by stitching.

Each sleeve portion may comprise one of a full length sleeve that extends approximately down to the wrist of a person when being worn and a partial length sleeve that extends down to approximately the elbow of a person when being worn.

Each torso portion may cover a chest, an underarm, and an upper back of a person when being worn.

Each neck portion may comprise a pull tab to facilitate decoupling of neck portions from one another.

One of the neck portions and the neck portions and the torso portions may comprise at least one fastener. The at least one fastener may be one of a snap, a zipper, a button, a knot and eye, a tie, a magnet, a clip, a catch, a hook, and a hook and loop member.

Each right side member and left side member may further comprise a pull member that is one of coupled to or integrally joined with an end portion of the sleeve portion. The pull member may be a cord member, a looped cord member, a looped string member, and a looped garment fabric.

In another aspect, this document features a method of protecting a garment from deodorant marks and stains while a person is dressing. The method may comprise: putting on the garment deodorant stain protector; putting on the garment over the installed garment deodorant stain protector; and removing the garment deodorant stain protector while the garment is on the person.

Implementations may comprise one or more of the following.

The method may further comprise removably coupling together right and left side members of a garment deodorant stain protector. Removably coupling together right and left side members may comprise one of: removably coupling to each other via at least one back fastener one of backs of neck portions and backs of neck portions and backs of torso portions; and removably coupling to each other via at least one front fastener one of fronts of neck portions and fronts of neck portions and fronts of torso portions.

Putting on the garment deodorant stain protector may comprise putting on the garment deodorant stain protector one arm at a time.

The method may further comprise removably coupling to each other via at least one fastener one of fronts of neck portions and fronts of neck portions and fronts of torso portions.

Removing the garment deodorant stain protector may comprise: uncoupling the right and left side members of the garment deodorant stain protector from each other; and pulling the separated right and left side members of the garment deodorant stain protector out through their corresponding garment sleeves.

Uncoupling the right and left side members of the garment deodorant stain protector from each other may comprise disengaging any fastener removably coupling the right and left side members of the garment deodorant stain protector together.

Pulling the separated right and left side members of the garment deodorant stain protector out through their corresponding garment sleeves may comprise one of pulling on pull members associated with the right and left side members and pulling on sleeve portions of the right and left side members.

The method may further comprise the person applying deodorant to underarms.

The foregoing and other aspects and implementations may have one or more or all of the following advantages. Garments are protected from damage and their appearance is preserved by preventing the garments from acquiring deodorant stains/marks when the garment is being put on by a person. Garment protector implementations can be easily removed after the garment is on the person without having to remove the garment first. Some garment protector implementations are washable and reusable, while others are disposable (e.g., capable of being used one time or a limited number times before being discarded). Some garment deodorant stain protector implementations are formed of materials that are flexible, resilient, and/or stretchable so as to be relatively tight-fitting when in use on at least a person's arms, while other garment deodorant stain protector implementations may be more loose fitting when installed on a person.

The foregoing and other aspects, implementations, features, and advantages will be apparent from the DESCRIPTION and DRAWINGS, and from the CLAIMS.

DRAWINGS

Implementations will hereinafter be described in conjunction with the appended DRAWINGS (which are not necessarily to scale), where like designations denote like elements.

DESCRIPTION

A Structure

Figure 1:
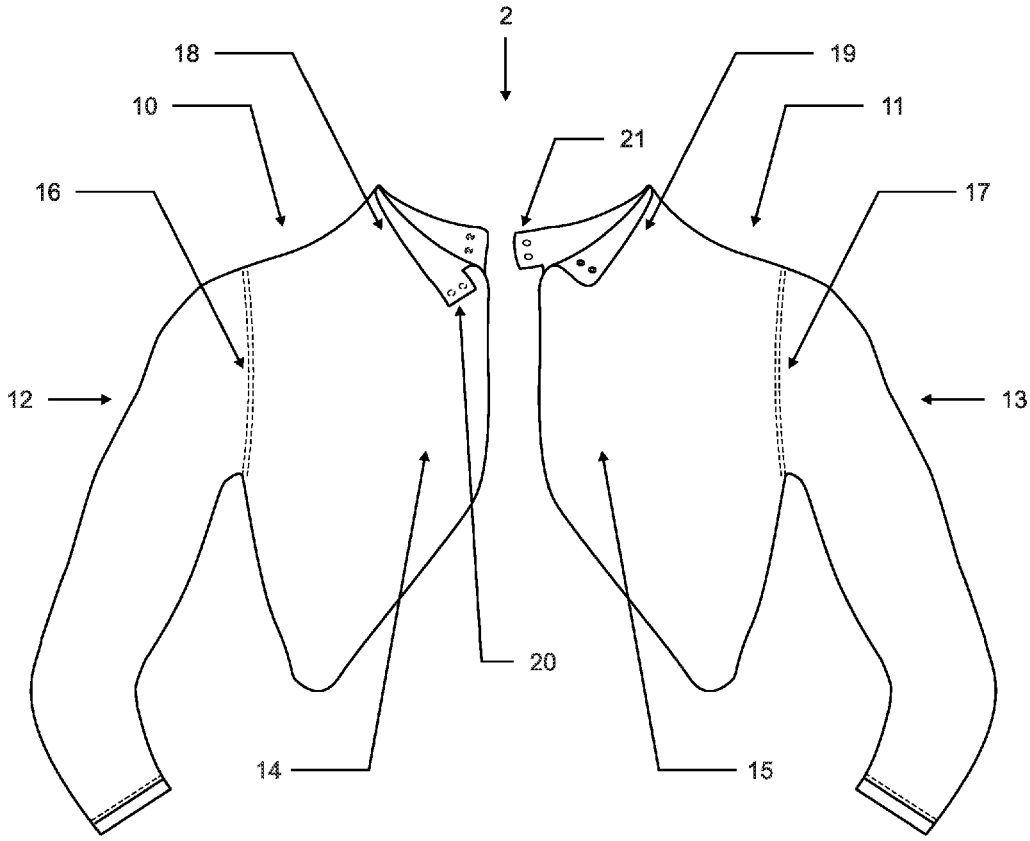
FIG. 1 is a front view of a garment deodorant stain protector implementation.

There is a variety of garment deodorant stain protector implementations that may be used when needed to protect clothing (for example, tight, pullover, and dark colored clothing) from deodorant stains/marks while a person is dressing. Notwithstanding, with reference to FIG. 1 and for the exemplary purposes of this disclosure, garment deodorant stain protector 2 is an example of a garment deodorant stain protector implementation.

Garment deodorant stain protector 2 may comprise two, distinct pieces—right side member 10 and left side member 11. Right side member 10 and left side member 11 may comprise sleeve portions 12 and 13 respectively, torso portions 14 and 15 respectively, and neck portions 18 and 19 respectively. Sleeve portions 12 and 13 may comprise long/full length sleeves that extend approximately down to the wrists of a person when being worn. Torso portions 14 and 15 may be upper torso portions for example that may cover the chest, underarms, and upper back of a person when being worn.

Sleeve portions 12 and 13 may be coupled to torso portions 14 and 15 by stitching 16 and 17 respectively, and neck portions 18 and 19 may be integrally joined to torso portions 14 and 15. Neck portions 18 and 19 may each comprise pull tabs 20 and 21 that facilitate the easy decoupling of neck portions 18 and 19 from one another by a person. Neck portions 18 and 19 may be removably coupled to each other in any manner, but in this particular implementation for example, they may be removably coupled to each other using corresponding pairs of snaps.

B Other Implementations

Many additional garment deodorant stain protector implementations are possible in addition to those previously discussed.

Figure 2:
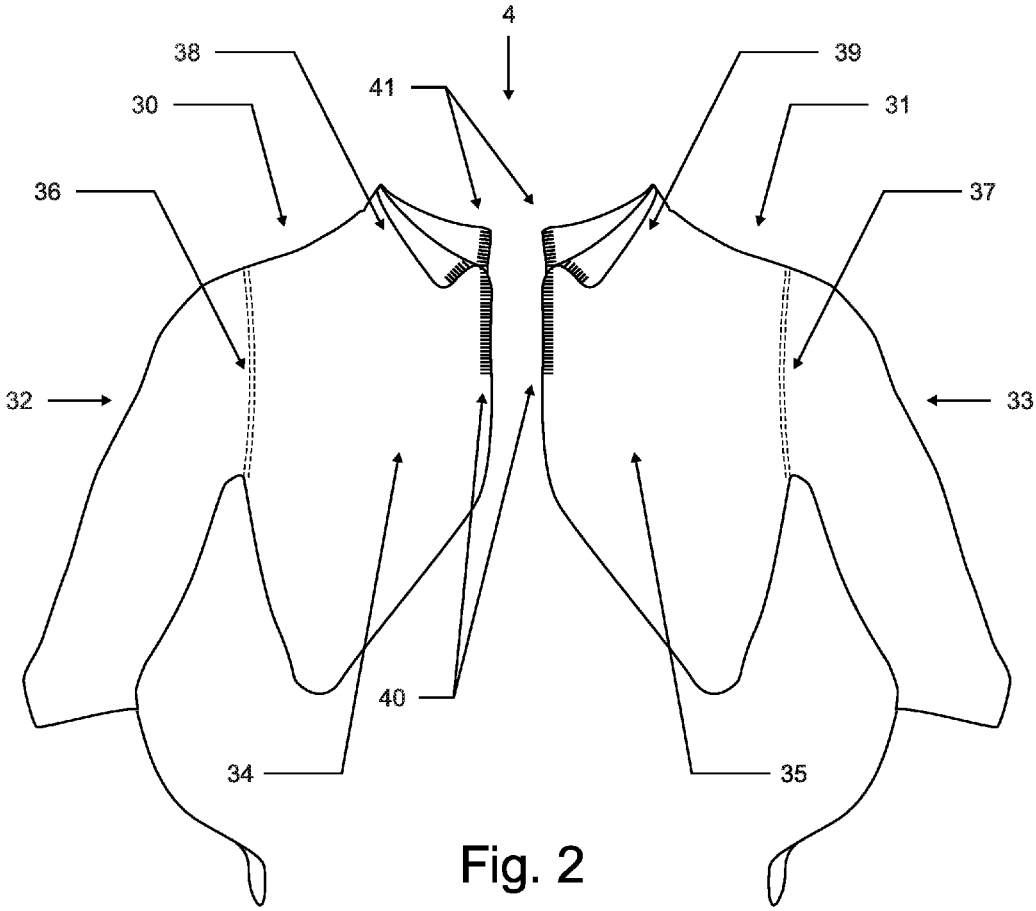
FIG. 2 is a front view of another garment deodorant stain protector implementation.

Turning to FIG. 2 and for the exemplary purposes of this disclosure, garment deodorant stain protector 4 is another garment deodorant stain protector implementation. Garment deodorant stain protector 4 is substantially similar to garment deodorant stain protector 2 depicted in FIG. 1 as previously described.

Accordingly, garment deodorant stain protector 4 may comprise two, distinct pieces—right side member 30 and left side member 31. Right side member 30 and left side member 31 may each comprise sleeve portions 32 and 33 respectively, torso portions 34 and 35 respectively, and neck portions 38 and 39 respectively. Sleeve portions 32 and 33 may comprise long/full length sleeves that extend down to the wrists of a person when being worn. Torso portions 34 and 35 cover the chest, underarms, and upper back of a person when being worn.

Sleeve portions 32 and 33 may be coupled to torso portions 34 and 35 by stitching 36 and 37 respectively, and neck portions 38 and 39 may be integrally joined to torso portions 34 and 35. Neck portions 38 and 39 and torso portions 34 and 35 may be removably coupled to each other in any manner, but in this particular implementation for example, they may be removably coupled to each other using front and back zippers 40 and 41 respectively.

Figure 3:
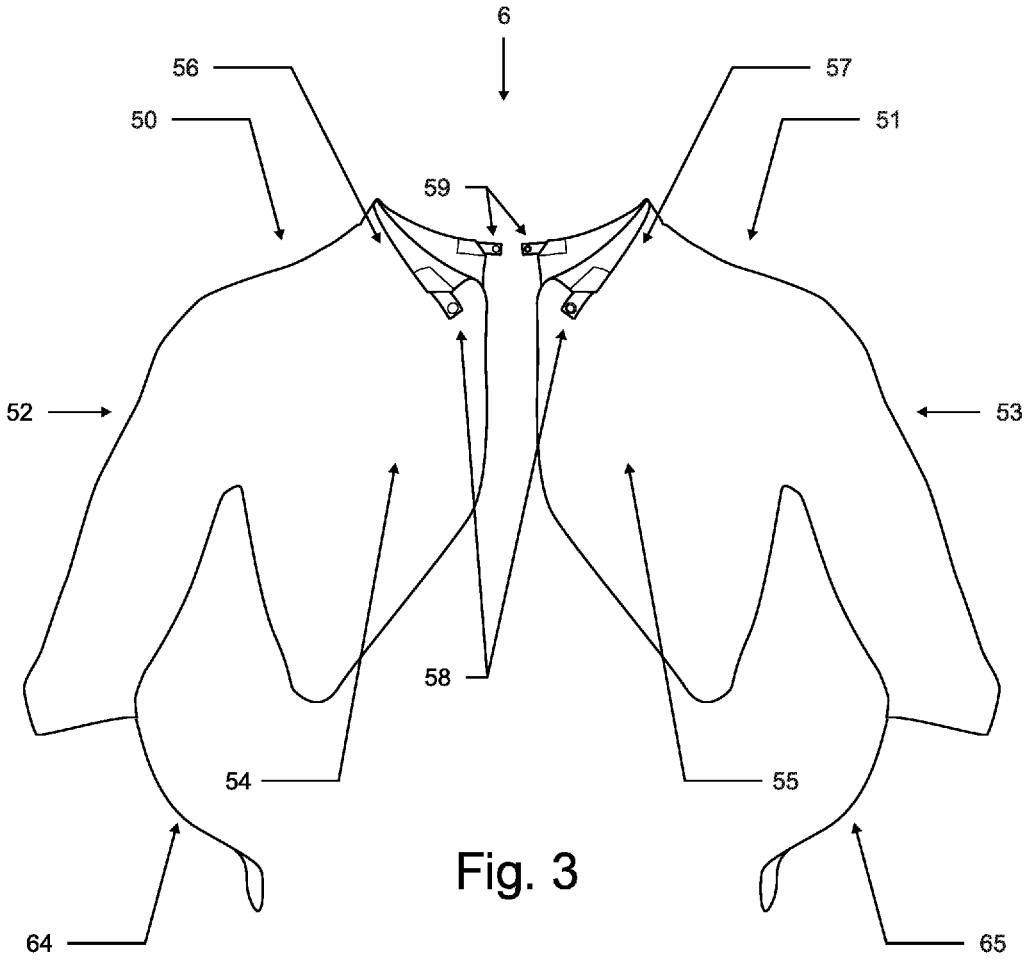
FIG. 3 is a front view of still another garment deodorant stain protector implementation.

Referring to FIG. 3 and for the exemplary purposes of this disclosure, garment deodorant stain protector 6 is an example of a garment deodorant stain protector implementation. Garment deodorant stain protector 6 is substantially similar to garment deodorant stain protector 2 depicted in FIG. 1 as previously described. The principle differences between them are the inclusion of a pair of pull members, the fastening mechanisms for removably coupling together the neck portions of the right and left side members, and the molded integrally joined components.

Figure 4:
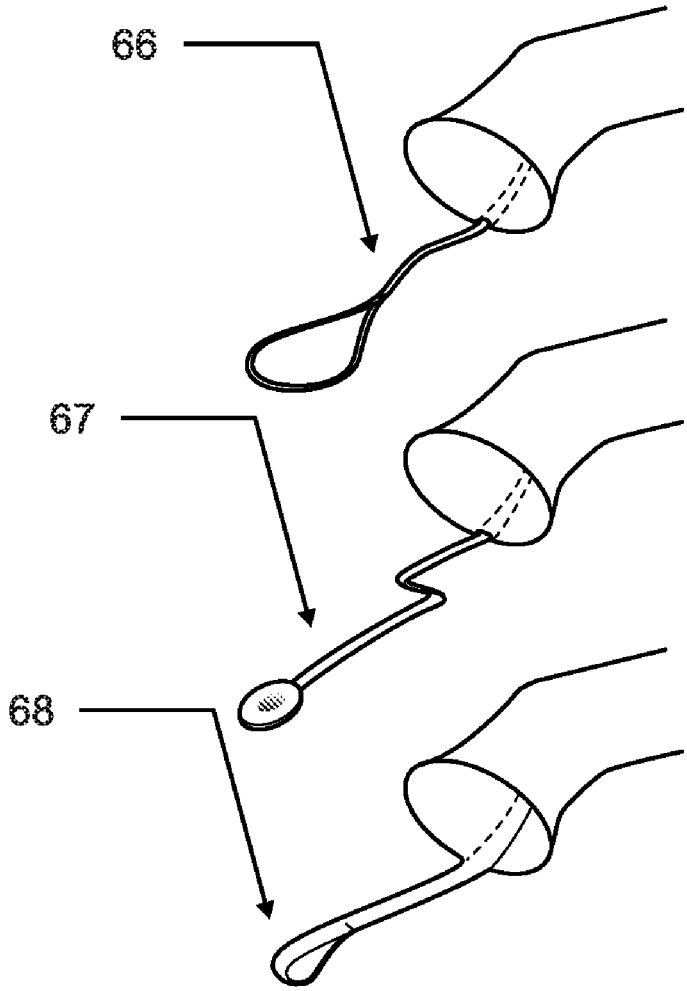
FIGS. 4-6 are front and perspective views of alternative components of the garment deodorant stain protector implementation of FIG. 3.
Figure 5:
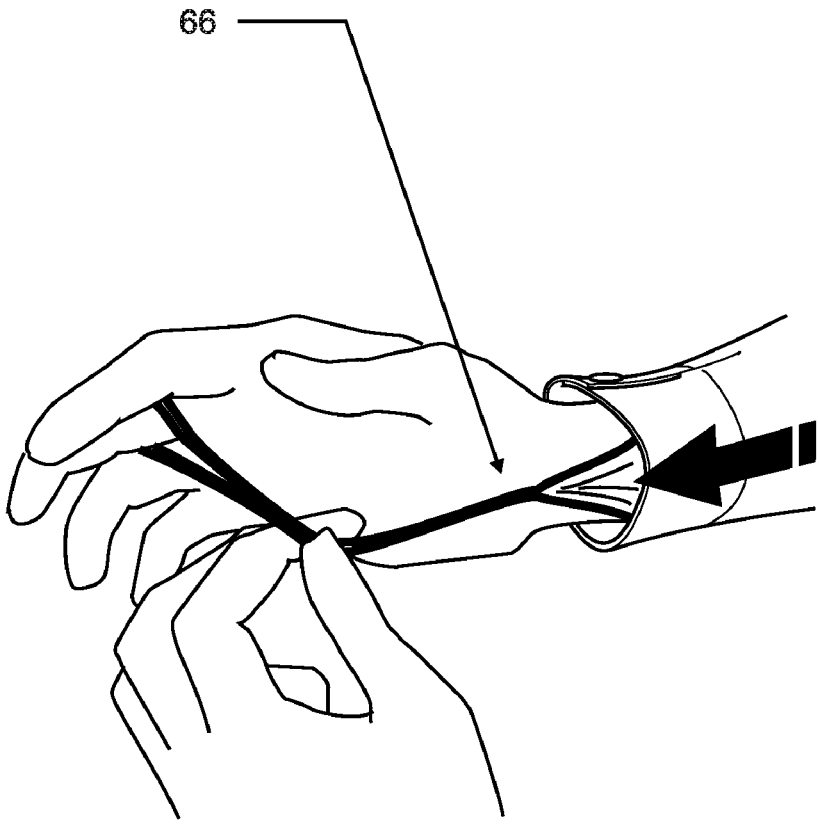
Figure 6:
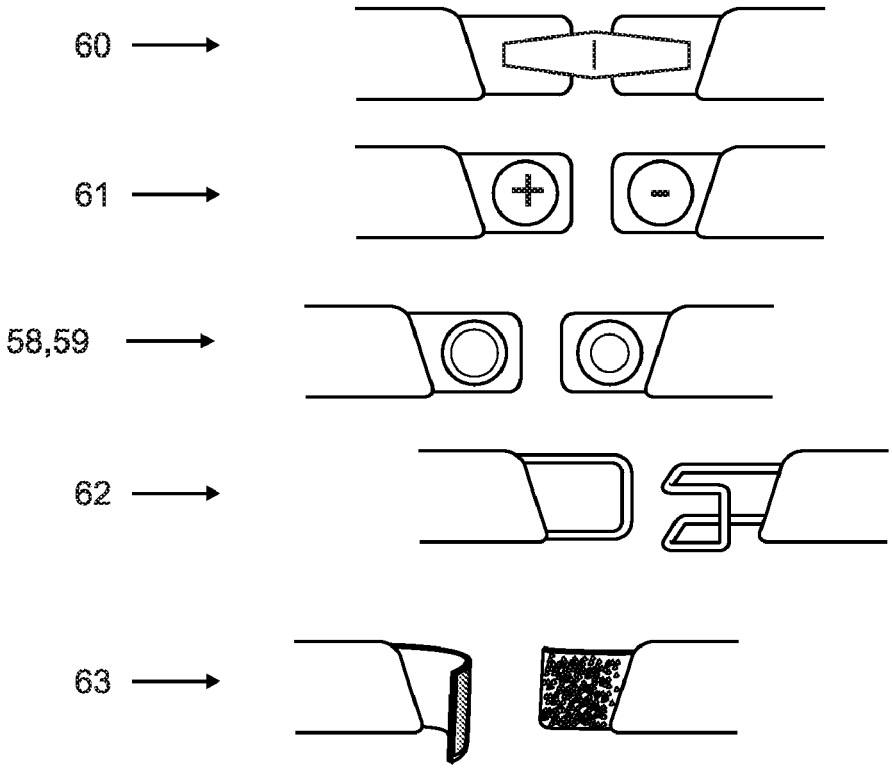

Accordingly, garment deodorant stain protector 6 may comprise two, distinct pieces—right side member 50 and left side member 51. Right side member 50 and left side member 51 may each comprise sleeve portions 52 and 53 respectively, torso portions 54 and 55 respectively, and neck portions 56 and 57 respectively. Torso portions 54 and 55 cover the chest, underarms, and upper back of a person when being worn. Sleeve portions 52 and 53 may comprise short/partial length sleeves that extend down to approximately the elbows of a person when being worn. Each pull member 64 and 65 may be coupled to or integrally joined with the end portion of the respective sleeve portions 52 and 53. As depicted in FIGS. 3-5, virtually any pull member may be used, such as looped cord members 66, looped string members 64 and 65, cord members 67, looped garment fabric 68, and the like for example.

Now referring to FIGS. 3 and 4, sleeve portions 52 and 53, torso portions 54 and 55, and neck portions 56 and 57 may be integrally joined to one another to form a unitary garment deodorant stain protector. Thus, for example, garment deodorant stain protector 6 may be formed by molding. Neck portions 56 and 57 may be removably coupled to each other in any manner using virtually any fastener. In this particular implementation for example, they may be removably coupled to each other using corresponding snaps 58 and 59 respectively. In other implementations, the fasteners may be either integrally joined with or coupled to the neck portions, and may comprise such fasteners as buttons (e.g. buttons 72-75 depicted in FIGS. 7 and 10), magnets 61, clips 60, catches 62, hooks, hook and loop members 63 (e.g. VELCRO®), a knot and eye, a tie, and the like. Moreover, the neck portions of other garment deodorant stain protector implementations may comprise multiple fasteners or a series of fasteners.

For the exemplary purposes of this disclosure, although there are a variety of garment deodorant stain protector implementations, some garment deodorant stain protector implementations may be washable and reusable, while other garment deodorant stain protector implementations may be disposable (e.g., capable of being used one time or a limited number times before being discarded).

For the exemplary purposes of this disclosure, although there are a variety of garment deodorant stain protector implementations, some garment deodorant stain protector implementations may be formed of materials that are flexible, resilient, and/or stretchable so as to be relatively tight-fitting when in use on at least a person's arms, while other garment deodorant stain protector implementations may be more loose fitting when installed on a person.

For the exemplary purposes of this disclosure, although there are a variety of garment deodorant stain protector implementations, some garment deodorant stain protector implementations may have areas of their torso and sleeve portions formed of perspiration- and/or deodorant-absorbing materials.

Further implementations are within the CLAIMS.

C. Specifications, Materials, and Manufacture

It will be understood that garment deodorant stain protector implementations are not limited to the specific components disclosed herein, as virtually any components consistent with the intended operation of a garment deodorant stain protector implementation may be utilized. Accordingly, for example, although particular side members, sleeve portions, torso portions, neck portions, fasteners, pull members, and other components are disclosed, such components may comprise any shape, size, style, type, model, version, class, grade, measurement, concentration, material, weight, quantity, and/or the like consistent with the intended operation of garment deodorant stain protector implementation. Implementations are not limited to uses of any specific components, provided that the components selected are consistent with the intended operation of a garment deodorant stain protector implementation.

Accordingly, the components defining any garment deodorant stain protector implementation may be formed of any of many different types of materials or combinations thereof that can readily be formed into shaped objects and that are consistent with the intended operation of a garment deodorant stain protector implementation. For example, the components may be formed of: fabrics (natural or synthetic, such as Acetate, Acrylic, Alpaca, Angora goat, Angora rabbit, Beaver, Broadcloth, Camel hair, Canvas, Cashmere, Challis, Chiffon, Crepe, Damask, Denim, Douppioni, Drill, Flannel, Gabardine, Georgette, Herringbone twill, Houndstooth, Mohair, Nylon, Organdy, Organza, Oxford, Polyester, Pongee, Rayon, Sateen, Satin, Spandex, Taffeta, Tussah, Velour, Velvet, Voile, Wool, and/or the like) fabric variants, fabric blends, and/or other like materials; disposable materials, such as polypropylene, polyethylene, DuPont Tyvek, paper and other pulp products, paper/poly film blends, and/or other like materials; rubbers (synthetic and/or natural) and/or other like materials; polymers such as thermoplastics, thermosets, any combination thereof, and/or other like materials; composites and/or other like materials; metals, such as zinc, magnesium, titanium, copper, iron, steel, carbon steel, alloy steel, tool steel, stainless steel, aluminum, any combination thereof, and/or other like materials; alloys, such as aluminum alloy, titanium alloy, magnesium alloy, copper alloy, any combination thereof, and/or other like materials; any other suitable material; and/or any combination of the foregoing.

Furthermore, the various implementations and components may be manufactured using conventional procedures as added to and improved upon through the procedures described here. Accordingly, the components defining any garment deodorant stain protector implementation may be purchased pre-manufactured or manufactured separately and then assembled together. If any of the components are manufactured separately, they may then be coupled with one another in any manner, such as with stitching, adhesive, fastener(s), tie(s), wire, any combination thereof, and/or the like for example, depending on, among other considerations, the particular material(s) forming the components.

However, any or all of the components may be manufactured simultaneously and integrally joined with one another. Accordingly, manufacture of these components separately or simultaneously may involve extrusion, pultrusion, vacuum forming, injection molding, blow molding, resin transfer molding, casting, forging, cold rolling, milling, drilling, reaming, turning, grinding, stamping, cutting, bending, welding, soldering, hardening, riveting, punching, plating, any combination thereof, and/or the like for example, depending on, among other considerations, the particular material(s) forming the components. Thus, for the exemplary purposes of this disclosure, in some implementations, the sleeve portions, the torso portions, and the neck portions may be molded and integrally joined to one another to form unitary right and left side members.

D. Use

Garment deodorant stain protector implementations are particularly useful in protecting clothing from getting deodorant marks and stains while a person is dressing. However, implementations are not limited to this use alone. Rather, any description relating to this use is for the exemplary purposes of this disclosure, and implementations may also be used in a variety of other applications with similar results.

For example, garment deodorant stain protector implementations can be left in place instead of being immediately removed (e.g., such as while finishing getting dressed or for trying on multiple outfits), acting as an undergarment essentially to absorb perspiration and protect garments from deodorant discoloration and the like. To enhance/supplement this type of use, garment deodorant stain protector implementations may comprise perspiration—and/or deodorant—absorbing material at the intersection of the torso and sleeve portions (i.e., the under arm area).

Notwithstanding, in describing the use of garment deodorant stain protector implementations further and for the exemplary purposes of this disclosure, FIGS. 7-13 depict garment deodorant stain protector 8 being used by person 80 to protect clothing from getting deodorant marks and stains while he is dressing. In this case, person 80 is a male, but the method applies equally to females as well. Garment deodorant stain protector 8 may be entirely or partially assembled/installed/disassembled/removed in the following manner.

Figure 7:
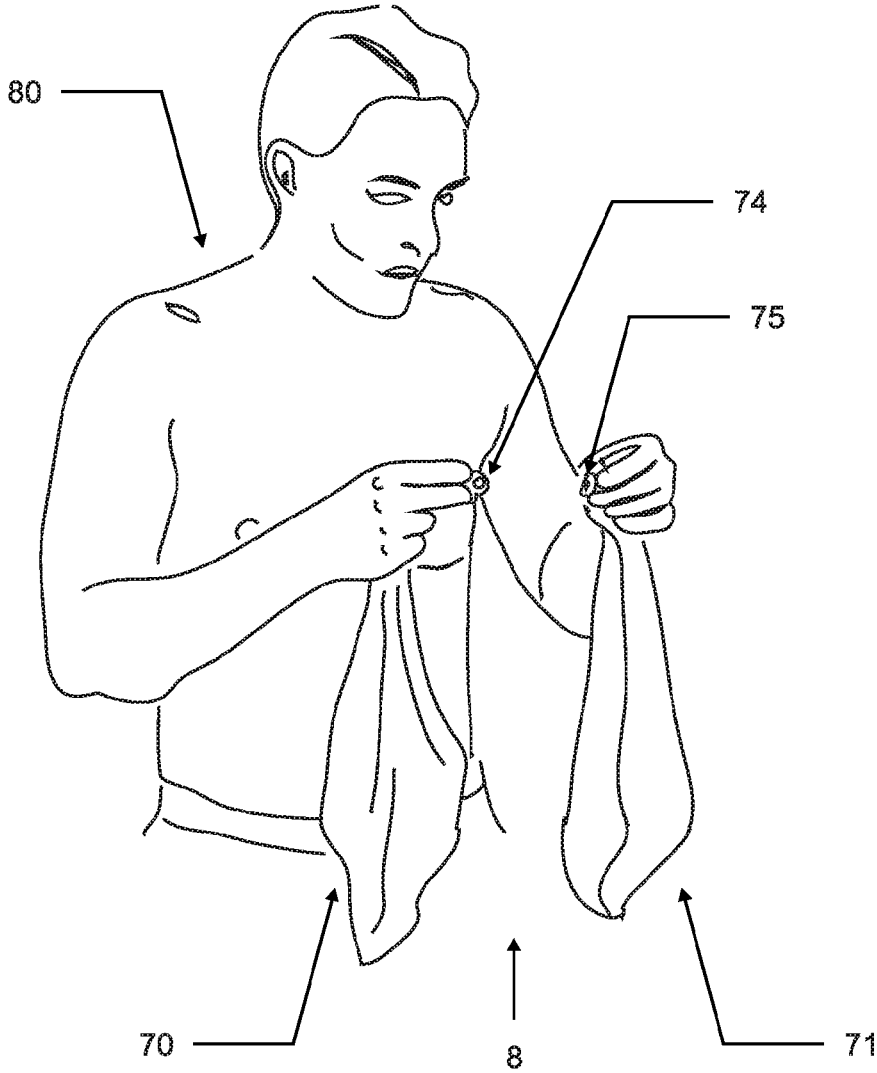
FIGS. 7-13 are various side and perspective views of yet another garment deodorant stain protector implementation during use.
Figure 8:
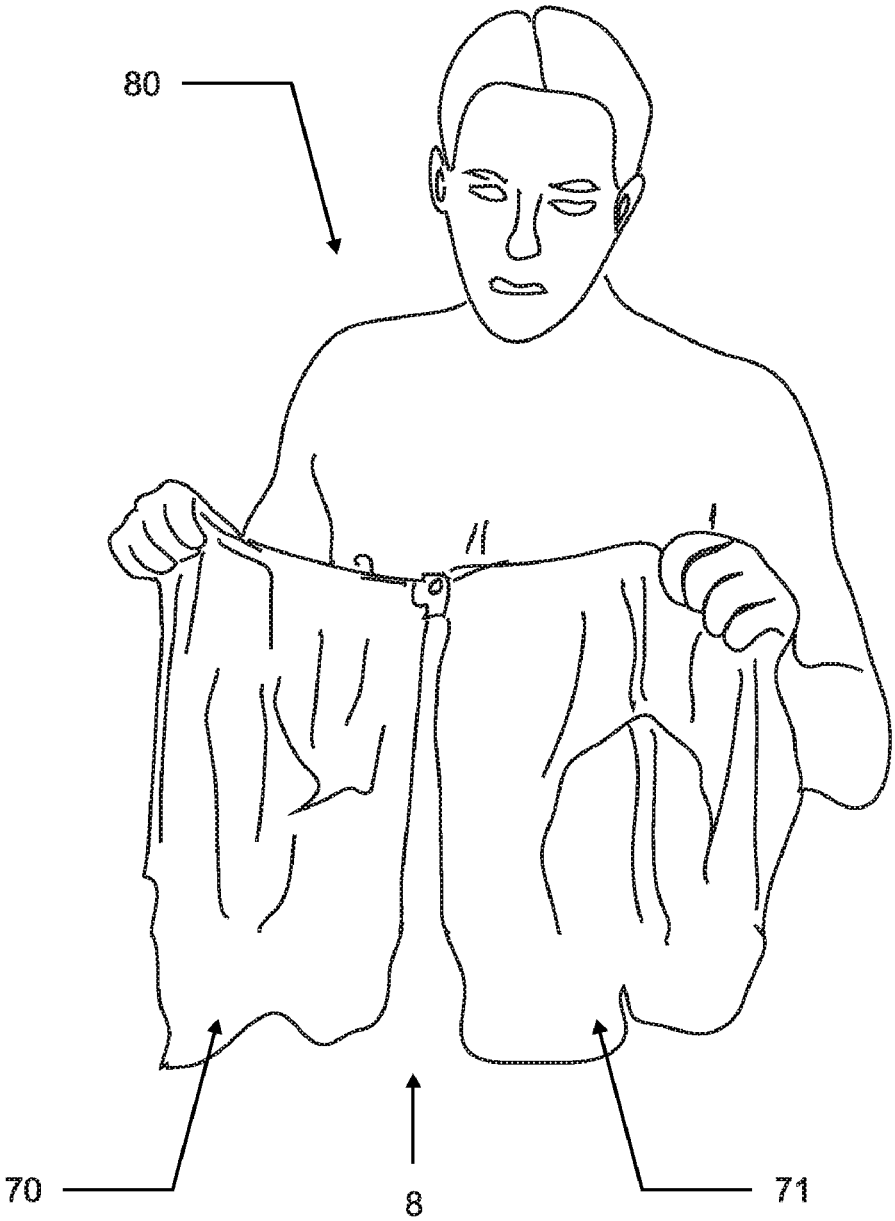

Assuming deodorant has been applied by person 80 to his underarms, right and left side members 70 and 71 may be removably coupled together. Referring to FIGS. 7-8, this may be accomplished by removably coupling the backs of the neck portions or the backs of the neck portions and the backs of the torso portions to each other via button fasteners 74 and 75. Alternatively, this may be accomplished by removably coupling the fronts of the neck portions or the fronts of the neck portions and the fronts of the torso portions to each other via button fasteners 72 and 73.

Figure 9:
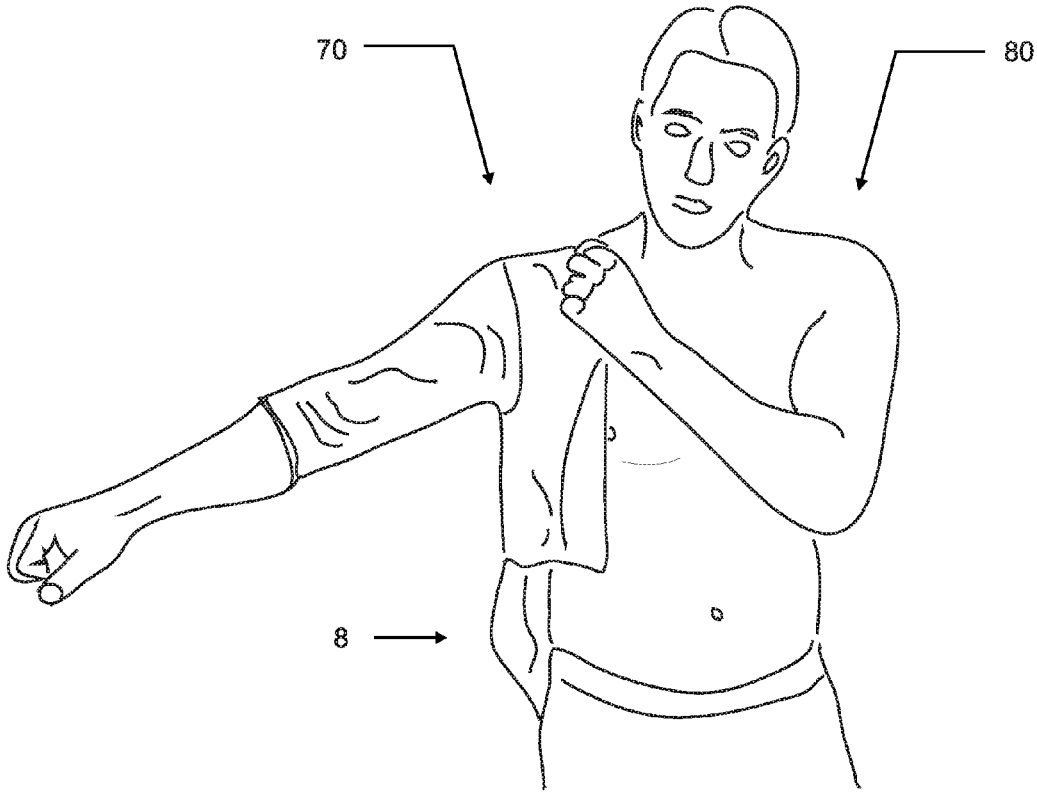
Figure 10:
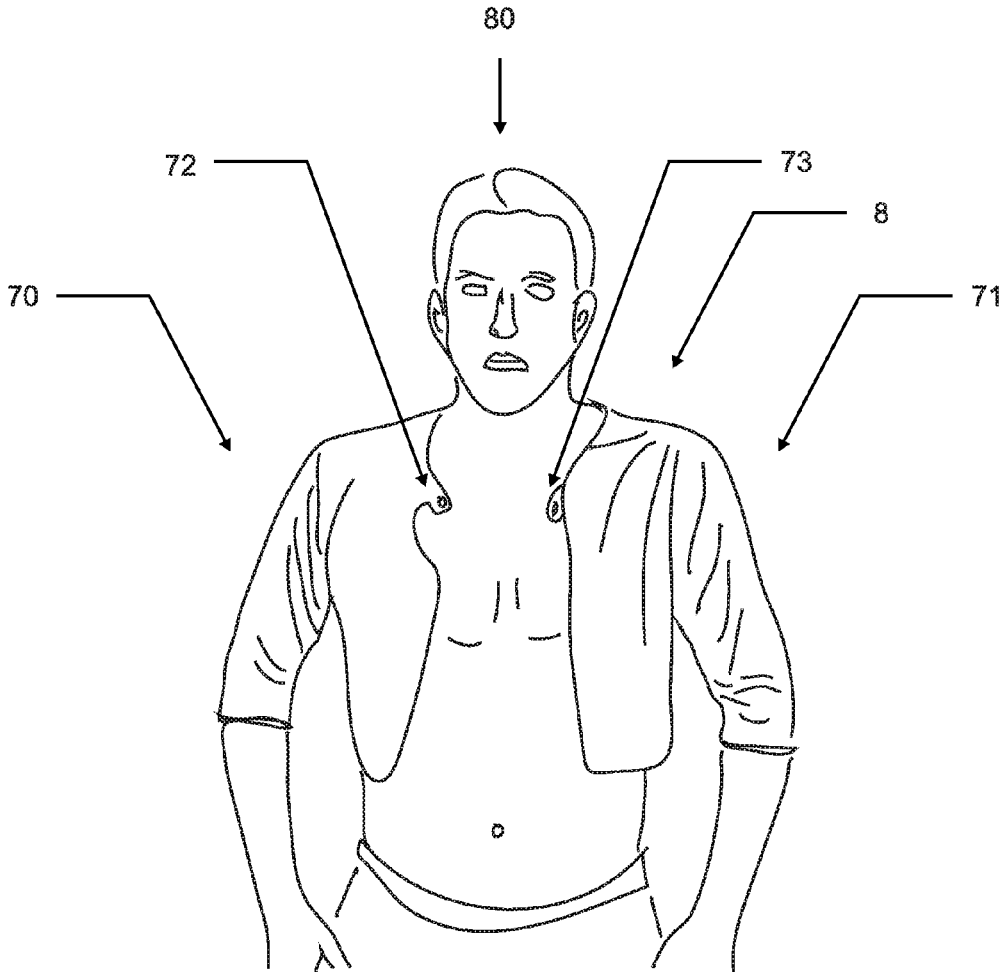

Next, person 80 may then put on garment deodorant stain protector 8. Turning to FIGS. 9-10, this may be accomplished by putting on garment deodorant stain protector 8 one arm at a time like with a vest, jacket, button-down shirt, or the like for example. Optionally and referring to FIG. 10, if person 80 has medium to large breasts or a larger chest for example, he/she may need to removably couple together front fasteners 72 and 73 or back fasteners 74 and 75 (depending upon which fasteners were engaged first) to keep garment protector 8 in position.

Figure 11:
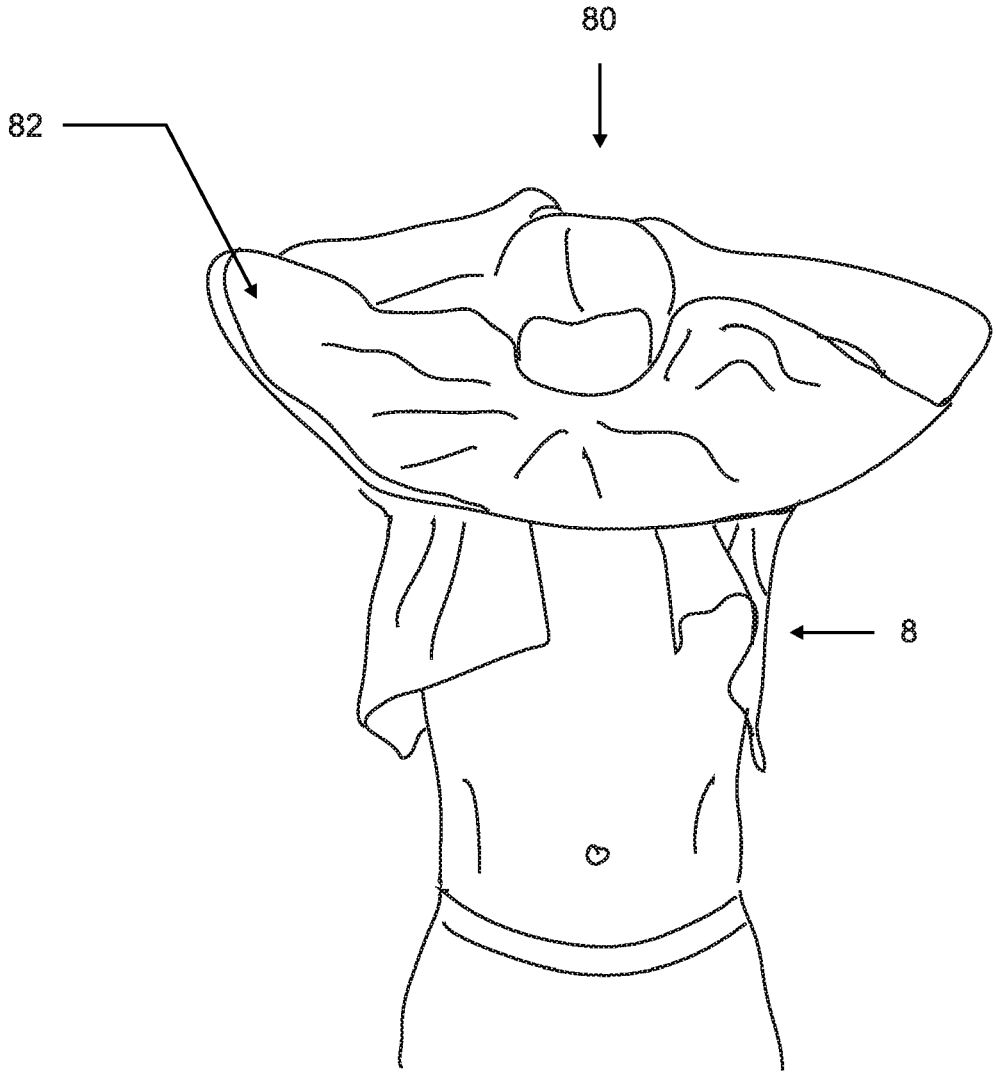

Next and turning to FIG. 11, whether using the front fasteners or not, person 80 may then put on garment 82 (shirt, blouse, dress, and the like for example) directly over temporarily installed garment deodorant stain protector 80 just as he normally would get dressed, but now with garment deodorant stain protector 8 protecting garment 82 from acquiring deodorant stains or marks.

Figure 12:
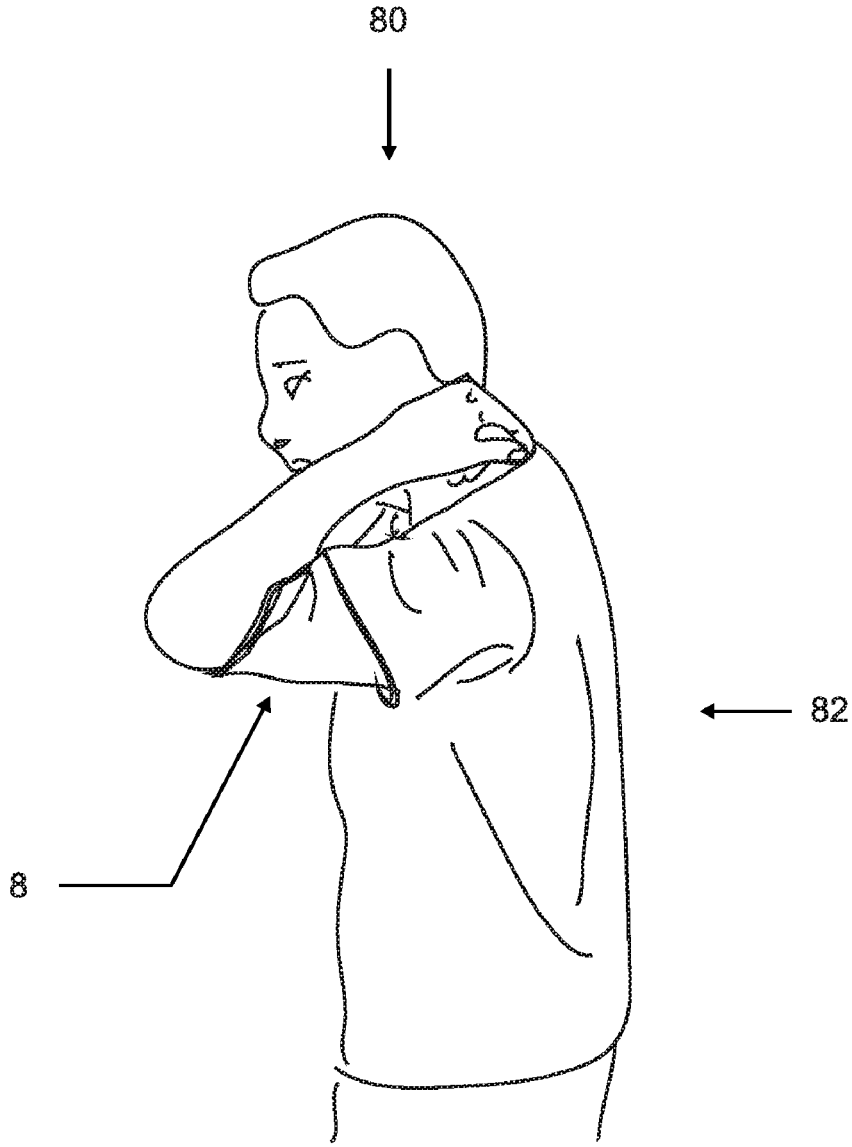
Figure 13:
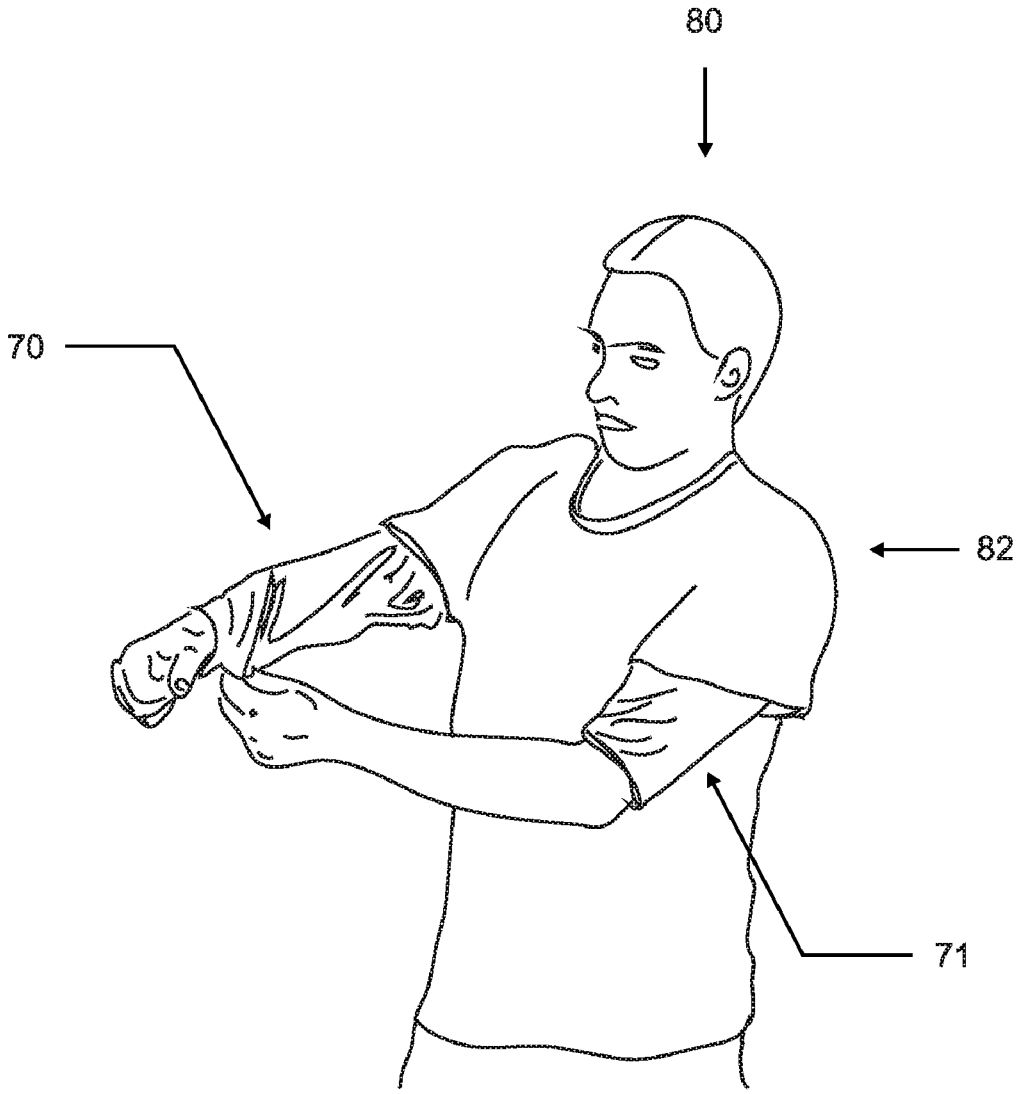

Finally and referring to FIGS. 12-13, garment protector 8 may be removed while the garment is on the person. This may be accomplished by uncoupling side members 70 and 71 from each other, and more specifically, disengaging back fasteners 74 and 75 (and front fasteners 72 and 73 if used). Then, each separated side members 70 and 71 of garment protector 8 may be easily pulled through and out the open end of its corresponding/adjacent garment sleeve leaving garment 82 unstained or marked by deodorant. If person 8 was dressing with a long sleeved shirt, blouse or dress for example, an alternative garment deodorant stain protector implementation (such as garment deodorant stain protector 6 for example) could be used that comprises pull members. The pull members could be used as depicted in FIG. 5 to both keep the garment deodorant stain protector implementation in position as the garment is pulled over the body and facilitate pulling the side members out the long sleeves of the particular shirt, blouse or dress when the garment protector needs to be removed. Alternatively, garment deodorant stain protector 8 may be left in place while garment 82 is worn instead of being immediately removed (e.g., such as while finishing getting dressed or for trying on multiple outfits), essentially acting as an undergarment to absorb perspiration and protect garments from deodorant discoloration and the like.

While the assembly/installation/disassembly/removal of a particular garment deodorant stain protector implementation has been described in a particular sequence of steps with reference to FIGS. 7-13, it will be understood that the assembly/installation/disassembly/removal of garment deodorant stain protector implementations are not limited to the steps or the specific order of steps as disclosed. Any steps or sequence of steps of the assembly/installation/disassembly/removal of a garment deodorant stain protector implementation indicated herein are given as examples of possible steps or sequence of steps and not as limitations, since various assembly/installation/disassembly/removal processes and sequences of steps may be used to assemble/install/disassemble/remove a garment deodorant stain protector implementation. Other garment deodorant stain protector implementations may be assembled/installed/disassembled/removed in similar manners.

The invention claimed is:

1. A garment deodorant stain protector comprising:

a right side member and a left side member configured to be removably couplable to one another where a person's neck meets a torso of the person when the garment deodorant stain protector is being worn, each right side member and left side member comprising:

a sleeve portion comprising no openings there through along its length and is one of coupled to or integrally joined with a corresponding torso portion;

a torso portion; and a neck portion integrally joined with a corresponding torso portion so that an upper edge of the neck portion is configured to be located where a person's neck meets the person's shoulder when the garment deodorant stain protector is being worn;

wherein each neck portion comprises a fixed pull tab that extends parallel to a skin surface of the person and outwardly away from the neck portion; and wherein the neck portion of the right side member comprises a first fastener component coupled thereto and a second fastener component coupled to the fixed pull tab, and the neck portion of the left side member comprises a third fastener component coupled thereto complimentary with the second fastener component and a fourth fastener component coupled to the fixed pull tab complimentary with the first fastener component, the fastener components configured to facilitate coupling and decoupling of the neck portion of the right side member from the neck portion of the left side member.

2. The garment deodorant stain protector of claim 1, wherein each sleeve portion is coupled to each torso portion by stitching.

3. The garment deodorant stain protector of claim 1, wherein each sleeve portion comprises one of a full length sleeve that extends approximately down to the wrist of a person when being worn and a partial length sleeve that extends down to approximately the elbow of a person when being worn.

4. The garment deodorant stain protector of claim 1, wherein each torso portion only covers a chest, an underarm, and an upper back of the person when being worn.

5. The garment deodorant stain protector of claim 1, wherein each fastener component and complementary fastener component together comprise a snap.

6. The garment deodorant stain protector of claim 1, wherein each right side member and left side member further comprises a pull member that extends outwardly away from and is one of coupled to or integrally joined with a distal free end portion of the sleeve portion.

7. The garment deodorant stain protector of claim 6, wherein the pull member is one of a cord member, a looped cord member, a looped string member, and a looped garment fabric.

8. A method of protecting a garment from deodorant marks and stains while a person is dressing, the method comprising:

providing a garment deodorant stain protector comprising: a right side member and a left side member configured to be removably couplable to one another where the person's neck meets a torso of the person when the garment deodorant stain protector is being worn, each right side member and left side member comprising: a sleeve portion comprising no openings there through along its length and is one of coupled to or integrally joined with a corresponding torso portion; a torso portion; and a neck portion integrally joined with a corresponding torso portion so that an upper edge of the neck portion is configured to be located where a person's neck meets the person's shoulder when the garment deodorant stain protector is being worn; wherein each neck portion comprises a fixed pull tab that extends parallel to a skin surface of the person and outwardly away from the neck portion; and wherein the neck portion of the right side member comprises a first fastener component coupled thereto and a second fastener component coupled to its fixed pull tab, and the neck portion of the left side member comprises a third fastener component coupled thereto complimentary with the second fastener component and a fourth fastener component coupled to its fixed pull tab complimentary with the first fastener component, the fastener components configured to facilitate coupling and decoupling of the neck portion of the right side member from the neck portion of the left side member;

putting on the garment deodorant stain protector;

putting on the garment over the garment deodorant stain protector; and removing the garment deodorant stain protector while the garment is on the person.

9. The method of claim 8, prior to the step of putting on the garment deodorant stain protector, further comprising the step of removably coupling together the right and left side members of the garment deodorant stain protector where a neck of the person meets a torso of the person.

10. The method of claim 9, wherein the step of removably coupling together right and left side members comprises one of: removably coupling backs of neck portions to each other via at least one back fastener; and removably coupling fronts of neck portions to each other via at least one front fastener.

11. The method of claim 8, wherein the step of putting on the garment deodorant stain protector comprises putting on the garment deodorant stain protector one arm at a time.

12. The method of claim 8 further comprising removably coupling to each other via at least one fastener fronts of neck portions where a neck of the person meets a torso of the person.

13. The method of claim 8, wherein the step of removing the garment deodorant stain protector comprises: uncoupling right and left side members of the garment deodorant stain protector from each other; and pulling the separated right and left side members of the garment deodorant stain protector out through their corresponding garment sleeves.

14. The method of claim 13, wherein the step of uncoupling the right and left side members of the garment deodorant stain protector from each other comprises disengaging any fastener removably coupling the right and left side members of the garment deodorant stain protector together.

15. The method of claim 13, wherein the step of pulling the separated right and left side members of the garment deodorant stain protector out through their corresponding garment sleeves comprises one of pulling on pull members that extend outwardly away from distal free end portions of sleeve portions of the right and left side members and pulling on sleeve portions of the right and left side members.

16. The method of claim 8, prior to the step of putting on the garment deodorant stain protector, further comprising the step of the person applying deodorant to underarms.

17. A garment deodorant stain protector comprising:

a right side member and a left side member, each right side member and left side member comprising a sleeve portion, a torso portion, and a neck portion;

wherein each sleeve portion is one of coupled to or integrally joined with each torso portion;

wherein each neck portion is integrally joined to each torso portion;

wherein each neck portion comprises a fixed pull tab that extends parallel to a skin surface of a person and outwardly away from the neck portion;

wherein the neck portion of the right side member comprises a first fastener component coupled thereto and a second fastener component coupled to the fixed pull tab, and the neck portion of the left side member comprises a third fastener component coupled thereto complimentary with the second fastener component and a fourth fastener component coupled to the fixed pull tab complimentary with the first fastener component, the fastener components configured to facilitate coupling and decoupling of the neck portion of the right side member from the neck portion of the left side member; and wherein the torso portions taper away from each other below the chest of the person when being worn and wherein each torso portion only covers a chest, an underarm, and an upper back of the person when being worn.

* * * * *